US009915893B2

(12) United States Patent
Kotani

(10) Patent No.: US 9,915,893 B2
(45) Date of Patent: Mar. 13, 2018

(54) DEVELOPING DEVICE, IMAGE FORMING APPARATUS INCLUDING DEVELOPING DEVICE, FITTING METHOD OF COIL BOARD TO DEVELOPING DEVICE

(71) Applicant: KYOCERA Document Solutions Inc., Osaka (JP)

(72) Inventor: Yukiko Kotani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/331,283

(22) Filed: Oct. 21, 2016

(65) Prior Publication Data

US 2017/0115598 A1 Apr. 27, 2017

(30) Foreign Application Priority Data

Oct. 27, 2015 (JP) ..... 2015-210923

(51) Int. Cl.
*G03G 15/08* (2006.01)
*G03G 15/09* (2006.01)

(52) U.S. Cl.
CPC ..... *G03G 15/0865* (2013.01); *G03G 15/0851* (2013.01); *G03G 15/0863* (2013.01); *G03G 15/09* (2013.01)

(58) Field of Classification Search
CPC ..... G03G 15/0865; G03G 15/09; G03G 15/0851; G03G 15/0863
USPC ..... 399/262
See application file for complete search history.

(56) References Cited

U.S. PATENT DOCUMENTS

2010/0290795 A1* 11/2010 Seki ..... G03G 15/0853 399/30
2012/0243886 A1* 9/2012 Sunayama ..... G03G 15/0865 399/27
2016/0084924 A1* 3/2016 Osumi ..... G01R 33/1223 324/236

FOREIGN PATENT DOCUMENTS

JP 2008203064 A * 9/2008
JP 2010-26031 A 2/2010

* cited by examiner

*Primary Examiner* — Billy Lactaoen
(74) *Attorney, Agent, or Firm* — Stein IP, LLC

(57) ABSTRACT

A developing device includes a housing for housing therein a developer containing toner and magnetic carrier, and a first sensor including an oscillation circuit and a coil board which is part of the oscillation circuit and on which a coil pattern is formed. A fitting portion formed by recessing an outer surface of the housing is provided in the housing so as to allow the coil board to be fitted at a position closer to the developer than the outer surface of the housing. The coil board is fitted into the fitting portion.

11 Claims, 7 Drawing Sheets

DEVELOPING DEVICE, IMAGE FORMING APPARATUS INCLUDING DEVELOPING DEVICE, FITTING METHOD OF COIL BOARD TO DEVELOPING DEVICE

This application is based upon and claims the benefit of priority from the corresponding Japanese Patent Application No. 2015-210923 filed on Oct. 27, 2015, the entire contents of which are incorporated herein by reference.

BACKGROUND

The present disclosure relates to a developing device for developing electrostatic latent images with toner, as well as to an image forming apparatus including the developing device.

Among such image forming apparatuses as multifunction peripherals, copiers, printers and facsimiles are those which use a developer including magnetic carrier and toner (so-called two-component developer) to fulfill printing. In developing process, only toner is consumed out of the magnetic carrier and the toner. Therefore, when a toner density in the developer has decreased in printing, there is a need for adding (supplying) toner to the developer. In this connection, a sensor using an LC oscillation circuit may be used for measurement of the toner density. A signal outputted by the LC oscillation circuit varies in frequency in response to the toner density (magnetic carrier density) in the developer. Based on such frequency changes, a toner density in the developer is detected. A known example of developing devices including an LC oscillation circuit is as follows.

As an example, there is known a developing device which includes a developer carrier, a developer housing tank, an LC oscillation circuit, and a toner density detector placed at a position where the inductance of a coil constituting the LC oscillation circuit is affected by toner density of the developer in the developer housing tank, in which arrangement the coil is made up from a scrolled print pattern which is formed on a flat plate and which has a print pattern-free hollow region at a central portion of the scroll. This structure is intended to provide a nearly flat distribution of detection sensitivities in the print-pattern central portion so that the detection result is less affected by variations of the developer quantity within the detection region.

As described above, in image forming apparatuses with use of a developer containing magnetic carrier and toner, a sensor including a coil may be used to detect the toner density (ratio of toner in the developer). In other words, the sensor uses a coil to detect increases of the ratio of magnetic carrier (magnetic-field variations) in the developer due to toner consumption.

With regard to a sensor using a coil, the more the distance between the developer and the coil increases, the more the variation in inductance of the coil relative to the variation in toner density decreases, causing the variation in sensor output (variation extent of frequency) to decrease. That is, the more the distance between the developer and the coil increases, the more difficult it becomes to detect the toner density accurately.

Conventionally, the sensor coil is placed outside the housing of the developing device. Inside the developing device, various members such as a rotator are provided. The developing device is required to have a certain level of strength. Therefore, the housing thickness cannot be made thinner than a certain level. The housing thickness causes the sensor coil to be distanced from the developer. Conventionally, the toner density detected by the sensor using a coil may involve large errors, hence a problem in terms of precision.

SUMMARY

A developing device according to one aspect of the disclosure includes a housing and a first sensor. The housing houses therein a developer containing toner and magnetic carrier. The first sensor includes an oscillation circuit and a coil board which is part of the oscillation circuit and on which a coil pattern is formed. A fitting portion formed by recessing an outer surface of the housing is provided in the housing so as to allow the coil board fitted at a position closer to the developer than the outer surface of the housing. The coil board is fitted to the fitting portion.

Further features and advantages of the disclosure will become apparent by embodiments thereof described hereinbelow.

DETAILED DESCRIPTION

Figure 1:
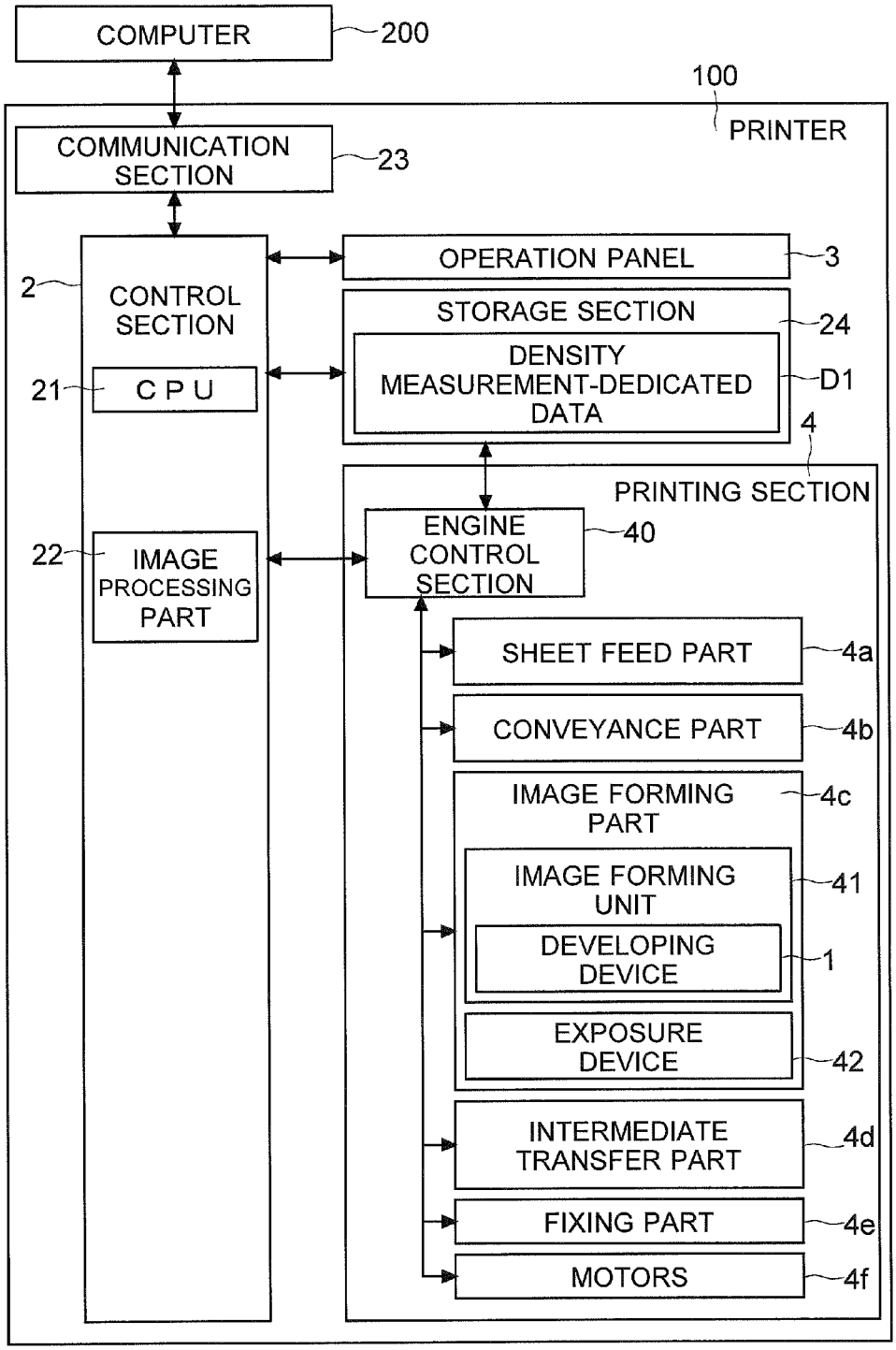
FIG. 1 is a diagram showing an example of a printer according to an embodiment.

Hereinbelow, an embodiment of the disclosure will be described with reference to FIGS. 1 to 15. In this disclosure, a sensor coil is positioned as close to the developer as possible to accurately detect a toner density. In the following description, a printer 100 (corresponding to image forming apparatus) including a developing device 1 will be described as an example. However, individual elements of the configuration, placement or the like described in the embodiment are merely descriptive examples and do not limit the scope of the disclosure.

(Outline of Image Forming Apparatus)

An outline of the printer 100 according to the embodiment will be described with reference to FIG. 1. A main control section 2 is provided in the printer 100. The main control section 2 controls operation of the printer 100. The main control section 2 is a control board including control circuits and arithmetic circuits such as a CPU 21 and an image processing part 22. The CPU 21 performs control over the individual parts of the printer 100, as well as various types of arithmetic processing, based on programs and data stored in a storage section 24. Based on printing-dedicated data transmitted from a computer 200 and received by a communication section 23, the image processing part 22 subjects image data to necessary image processing such as density conversion, scale-up, scaled-down and rotation. The printing-dedicated data include data indicative of print settings and print contents.

The storage section 24 is a combination of a nonvolatile storage device such as ROM or HDD and a volatile storage device such as RAM. The storage section 24 stores therein control-dedicated programs for control over the printer 100 as well as various types of data such as control data, setting data and image data.

The printer 100 includes an operation panel 3. The operation panel 3 includes a display panel and hard keys. The display panel displays thereon a status of the printer 100, various messages, and various setting screens. The display panel is an LCD (Liquid Crystal Display) panel as an example. The main control section 2 controls the display of the operation panel 3. The hard keys are for setting operation and provided in plurality. The main control section 2 recognizes setting contents in the operation panel 3 and controls the printer 100 in accordance with the setting contents.

The printer 100 includes a printing section 4. The printing section 4 includes a sheet feed part 4*a*, a conveyance part 4*b*, an image forming part 4*c*, an intermediate transfer part 4*d*, and a fixing part 4*e*. An engine control section 40 (corresponding to the control section) is provided in the printer 100. The engine control section 40 actually controls operations of the sheet feed part 4*a*, the conveyance part 4*b*, the image forming part 4*c*, the intermediate transfer part 4*d*, and the fixing part 4*e*. Inside the printer 100, a plurality of motors 4*f* for rotating various rotators of the printing section 4 are provided.

The main control section 2 gives the engine control section 40 a printing instruction, contents of a printing job, and image data to be used for printing. The engine control section 40 controls such printing-related processes as sheet feed, sheet conveyance, toner image formation, transfer, fixing, toner density recognition, and toner supply.

The engine control section 40 instructs the sheet feed part 4*a* to feed printing-use sheets of paper, one by one. The engine control section 40 is a control board including control circuits such as CPU and storage devices such as ROM and RAM. The engine control section 40 instructs the conveyance part 4*b* to convey a fed sheet up to a discharge tray (not shown). The sheet is conveyed via the image forming part 4*c*, the intermediate transfer part 4*d* and the fixing part 4*e*. The engine control section 40 instructs the image forming part 4*c* to form a toner image to be transferred onto the conveyed sheet. The printer 100 is compatible with color printing. The image forming part 4*c* includes a plurality of image forming units 41. In more detail, there are provided an image forming unit 41Bk for forming a black toner image, an image forming unit 41C for forming a cyan toner image, an image forming unit 41Y for forming a yellow toner image, and an image forming unit 41M for forming a magenta toner image (see FIG. 2).

Figure 2:
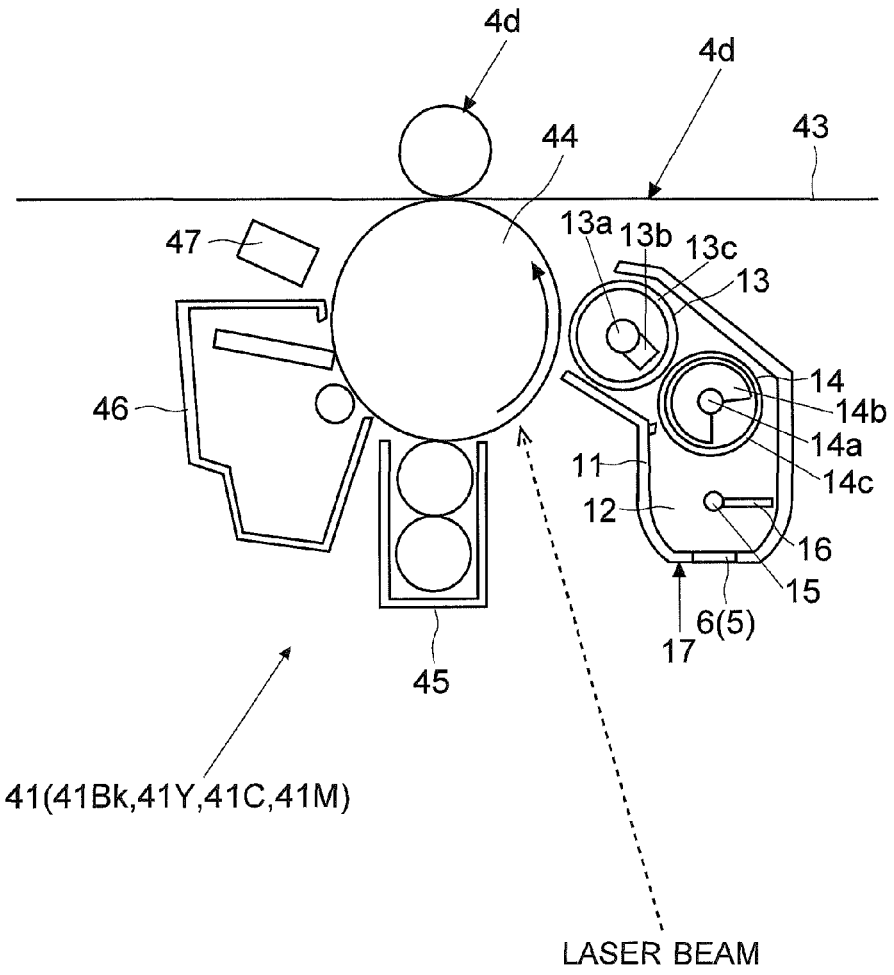
FIG. 2 is a view showing an example of the structure of each image forming unit according to the embodiment.

The intermediate transfer part 4*d* includes an intermediate transfer belt 43 (see FIG. 2). The intermediate transfer belt 43 is subjected to primary transfer of individual-color toner images formed by the individual image forming units 41, respectively. The engine control section 40 instructs the intermediate transfer belt 43 to rotate. The engine control section instructs the intermediate transfer part 4*d* to perform secondary transfer. As a result, the toner images superimposed on the intermediate transfer belt 43 are transferred onto the conveyed sheet. The engine control section 40 instructs the fixing part 4*e* to fix the toner images transferred onto the sheet.

(Configuration of Each Image Forming Unit 41)

Next, an example of the configuration of each image forming units 41 according to the embodiment will be described with reference to FIG. 2. The image forming part 4*c* includes four-color image forming units 41Bk, 41Y, 41C, 41M (41Bk to 41M). The image forming part 4*c* also includes an exposure device 42 for exposing to light a photosensitive drum 44 included in each image forming unit 41 (see FIG. 1).

The image forming units 41Bk to 41M will be described in detail with reference to FIG. 2. The image forming units 41Bk to 41M differ from one another in color of toner images to be formed. However, those image forming units are basically similar in configuration. Therefore, the image forming unit 41Bk for black color will be described as an example hereinbelow. The other image forming units 41 can also be described similarly. In the following description, color-indicating signs of Bk, Y, C and M will be omitted except for occasions of particular explanation. Common component members will be designated by signs in common among the image forming units 41.

As shown in FIG. 2, each image forming unit 41 includes the photosensitive drum 44, a charging device 45, the developing device 1, a cleaning device 46, and a charge eliminating device 47.

The engine control section 40 instructs the photosensitive drum 44 to rotate at a specified circumferential speed by driving force of the motors 4*f* (see FIG. 1). The photosensitive drum 44 carries a toner image on its circumferential surface through the charging, exposure and developing processes (serving as an image carrier). The engine control section 40 instructs the charging device 45 to electrically charge the surface of the photosensitive drum 44 to a certain voltage level. The exposure device 42 is placed below the image forming unit 41. The engine control section 40 instructs the exposure device 42 to apply laser light toward the photosensitive drum 44. The exposure device 42 includes such optical system members (not shown) as a semiconductor laser device (laser diode), a polygon mirror, a polygon motor, an fθ lens, and a mirror. The exposure device 42 applies, to the charged photosensitive drum 44, an optical signal (laser light, indicated by broken line in FIG. 2) based on an image signal (a signal resulting from color separation of image data) with use of optical system members. The photosensitive drum 44 is subjected to scanning and exposure. As a result, an electrostatic latent image obtained in accordance with the image data is formed on the circumferential surface of the photosensitive drum 44.

The developing device 1 contains a developer (two-component developer) inside a housing 11. The developer includes toner and magnetic carrier. The developer is stored in a developer tank 12 inside the developing device 1. The developing device 1 of the image forming unit 41Bk contains a black developer, the developing device 1 of the image forming unit 41Y contains a yellow developer, the developing device 1 of the image forming unit 41C contains a cyan developer, and the developing device 1 of the image forming unit 41M contains a magenta developer. Each developing device 1 is connected to a toner container 48 (see FIG. 3) that contains the toner of its corresponding color. In response to consumption of the toner, the developing device 1 is supplied with toner from the container.

The developing device 1 includes a developing roller 13, a magnetic roller 14, and a stirring member 15. The developing roller 13 faces the photosensitive drum 44, with their axis lines set parallel to each other. Between the developing roller 13 and the photosensitive drum 44, a small gap is provided. During printing process, a toner thin layer is formed on the circumferential surface of the developing roller 13. The developing roller 13 carries charged toner thereon. A voltage is applied to the developing roller 13. The toner flies toward the photosensitive drum 44 to develop the electrostatic latent image. The magnetic roller 14 faces the developing roller 13, with their axis lines set parallel to each other. A voltage is applied to the magnetic roller 14 for the purposes of supply, collection and removal of toner to and from the developing roller 13.

A roller shaft 13*a* of the developing roller 13 and a roller shaft 14*a* of the magnetic roller 14 are fixedly supported by shaft support members. A magnet 13*b* extending along the axis line and having a generally rectangular-shaped cross section is mounted on the roller shaft 13*a*. Also, a magnet 14*b* extending along the axis line and having a generally sectorial-shaped cross section is mounted on the roller shaft 14*a*. The developing roller 13 and the magnetic roller 14 have cylindrical-shaped sleeves 13*c*, 14*c* covering the magnets 13*b*, 14*b*, respectively. The sleeves 13*c*, 14*c* are rotated by unshown drive mechanisms under the drive by the motors 4*f*.

At a position where the developing roller 13 and the magnetic roller 14 face each other (where the gap therebetween is the narrowest), different poles of the magnet 13*b* and the magnet 14*b* face each other. As a result, a magnetic brush of the magnetic carrier is formed at the gap between the developing roller 13 and the magnetic roller 14. Rotation of the sleeve 14*c* carrying the magnetic brush as well as voltage application to the magnetic roller 14 cause the toner to be supplied to the developing roller 13. Thus, a toner thin layer is formed on the developing roller 13. The magnetic brush scrapes off and collects up toner remaining on the surface of the developing roller 13.

In the developing device 1, a stirring member 15 for stirring the developer is provided. The stirring member 15 is provided under the magnetic roller 14. The stirring member 15 is rotated under the drive by the motors 4*f*. The stirring member 15, having a scraper 16, stirs the developer. The toner is electrically charged by friction with the carrier due to stirring.

The scraper 16 is provided with a recess or a blade (not shown). By virtue of this, scraped-up developer is dispersed in axial directions of the developing roller 13 and the magnetic roller 14. Supplied toner is dispersed in the axial direction of the developing roller 13. The toner is uniformly distributed in the developing device 1. A flat coil board 6 (corresponding to coil board) is provided at a bottom surface 17 of the housing 11 (developer tank 12). The flat coil board 6 forms part of a toner density sensor 5 (first sensor). The flat coil board 6 may be provided at a place other than the bottom surface 17 of the housing 11.

The engine control section 40 instructs the cleaning device 46 to clean the photosensitive drum 44. The cleaning device 46 rubs the surface of the photosensitive drum 44 to eliminate remaining toner or the like. The engine control section 40 also instructs the charge eliminating device 47 to apply light to the photosensitive drum 44 to thereby eliminate the charge.

(Toner Supply Mechanism 49)

Figure 3:
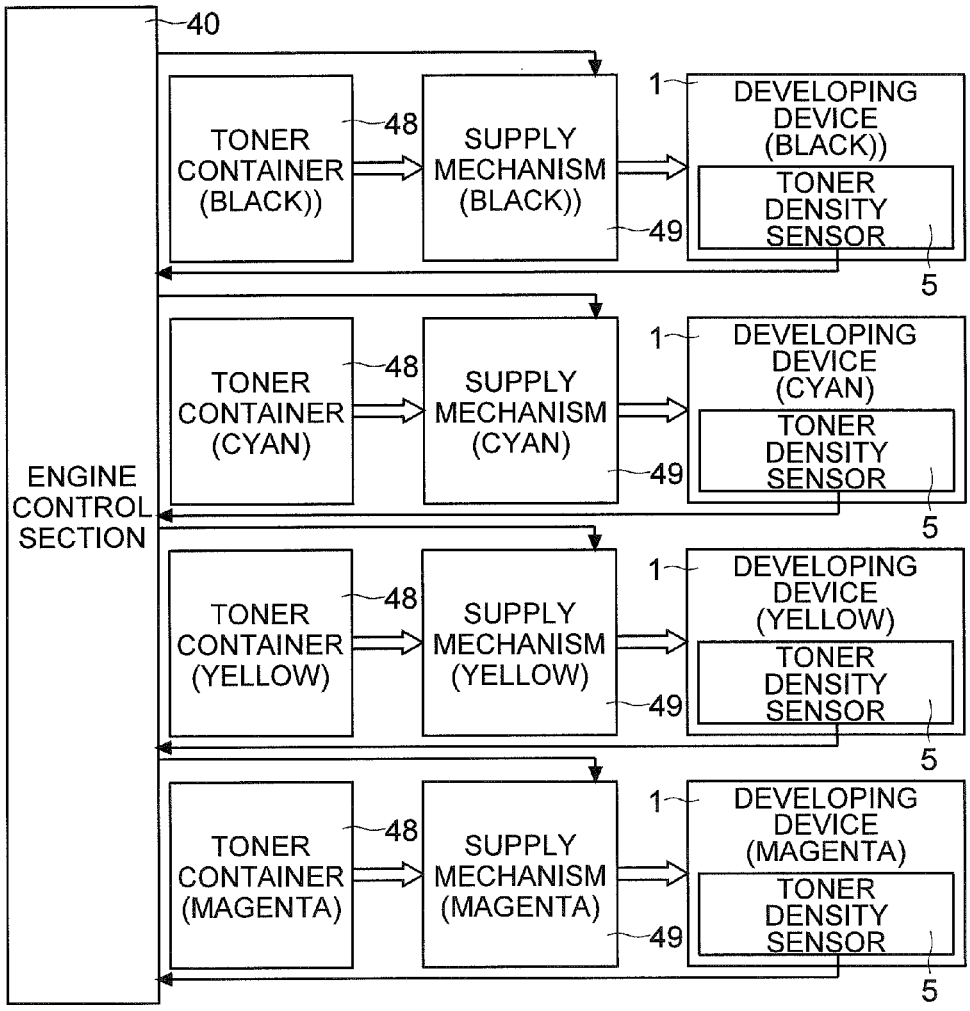
FIG. 3 is a diagram showing an example of the mechanism for supplying toner to each developing device according to the embodiment.

Next, a mechanism for supplying toner to each developing device 1 will be described with reference to FIG. 3. In FIG. 3, the flow of toner is indicated by hollow arrows.

In the printer 100, a toner container 48 and a supply mechanism 49 are provided for each toner color. The toner container 48 contains therein supply-use toner. The supply mechanism 49 feeds toner from the toner container 48 to the developing device 1 for supplemental supply. As printing progresses, the magnetic carrier also may decrease by degrees. In some cases, a trace quantity of magnetic carrier may be mixed in the toner container 48. One toner density sensor 5 is provided for each developing device 1. The toner density sensor 5 detects a toner density in the developing device 1 (a ratio of toner in the developer). By this detection, it can be checked whether or not the toner density is equal to or more than a specified value.

A total of four toner containers 48 for black, cyan, yellow and magenta are attached to the printer 100. Each toner container 48, being replaceable, can be replaced with another when emptied. Each supply mechanism 49 includes a conveyance screw (not shown) for feeding the toner to the developing device 1, and a motor and a gear (not shown) for rotating the conveyance screw.

An output of each toner density sensor 5 is inputted to the engine control section 40. The engine control section 40 checks outputs of the individual toner density sensors 5 at main power-on, at recovery to the normal mode, during printing process, before start of a printing job, or other occasions. Then, the engine control section 40 checks whether or not any of the developing devices 1 has a toner density less than the specified value. The engine control section 40 instructs a supply mechanism 49 corresponding to a developing device 1 having a toner density less than the specified value to operate. The engine control section 40 instructs the supply mechanism 49 to supply toner to the developing device 1 having a toner density less than the specified value. When recognizing based on an output of the toner density sensor 5 that the toner quantity has reached the specified value or more, the engine control section 40 stops the supply mechanism 49 from operating.

(Toner Density Sensor 5)

Figure 4:
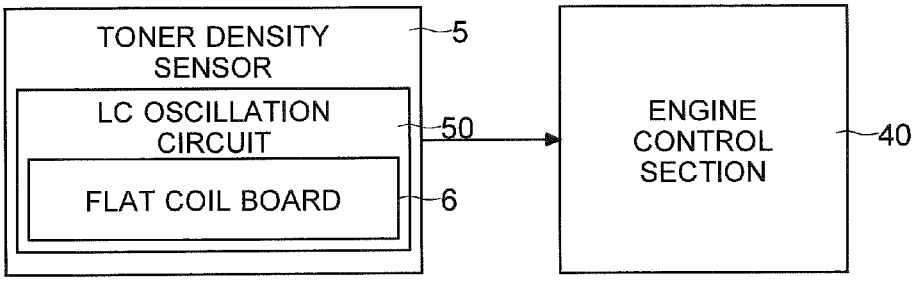
FIG. 4 is a diagram showing an example of a first sensor according to the embodiment.

Next, the toner density sensor 5 will be described with reference to FIGS. 4 and 5. As shown in FIG. 4, the toner density sensor 5 includes an LC oscillation circuit 50 (corresponding to oscillation circuit). The LC oscillation circuit 50 includes a flat coil board 6 on which a coil pattern 61 is formed. An output of the toner density sensor 5 (LC oscillation circuit 50) is inputted to the engine control section 40. Based on a frequency of the LC oscillation circuit 50, the engine control section 40 detects a toner density in the developer.

Figure 5:
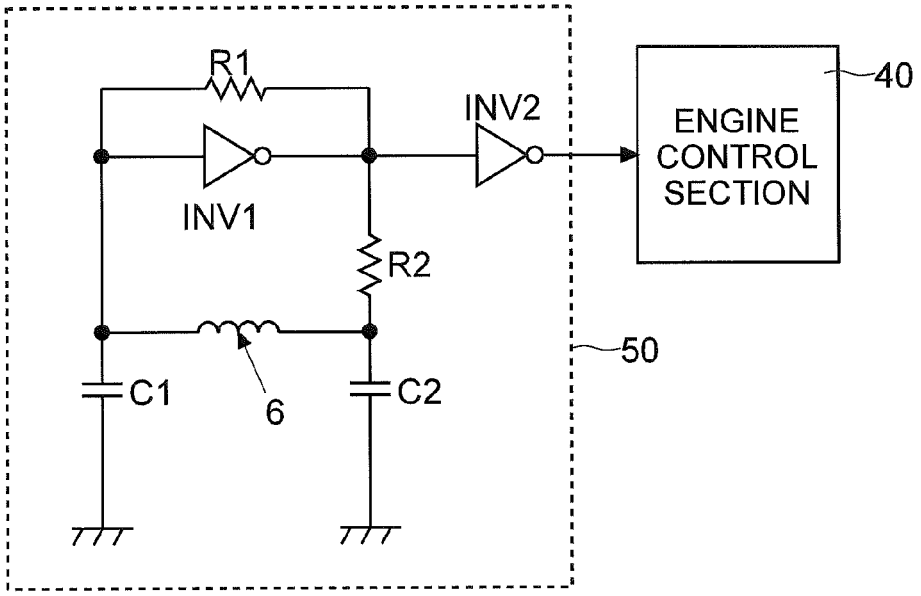
FIG. 5 is a diagram showing an example of an LC oscillation circuit according to the embodiment.

FIG. 5 shows an example of the LC oscillation circuit 50. The LC oscillation circuit 50 includes the flat coil board 6, a first resistor R1, a second resistor R2, a first capacitor C1, a second capacitor C2, a first inverter INV1, and a second inverter INV2. The LC oscillation circuit 50 shown in FIG. 5 is a kind of Colpitts type oscillation circuit.

One terminal of the flat coil board 6 is connected to one end of the first capacitor C1, an input terminal of the first inverter INV1, and one end of the first resistor R1. The other terminal of the flat coil board 6 is connected to one end of the second capacitor C2 and one end of the second resistor R2. The other end of the first capacitor C1 and the other end of the second capacitor C2 are connected to the ground. An output terminal of the first inverter INV1 is connected to the other end of the first resistor R1, the other end of the second resistor R2, and an input terminal of the second inverter INV2. An output of the second inverter INV2 is inputted to the engine control section 40.

The second resistor R2, the first capacitor C1, the second capacitor C2 and the flat coil board 6, which constitute a negative feedback circuit, functions to turn the phase 180 degrees around. As a result, the negative feedback turns into positive feedback, causing oscillations. Its resulting oscillation frequency is $f=\frac{1}{2\pi}((LC)^{1/2})$. A sinusoidal wave is inputted to the second inverter INV2. The second inverter INV2 transforms the inputted sinusoidal wave into a rectangular wave.

The flat coil board 6 has a plurality of layers. In each layer, a spiral coil pattern 61 (see FIG. 10) is formed. The coil pattern 61 of each layer is connected to a coil pattern of another layer (a coil pattern 61 of an up/down neighboring layer) by via technique (via hole). As a result of this, lead wires (patterns) within the flat coil board 6 are formed into a wound-and-lapped one lead wire.

In this case, the flat coil board 6 is fitted to the housing 11 of the developing device 1 (later described in detail). The inductance of the flat coil board 6 varies depending on the density of the magnetic carrier in the developer. When the toner is consumed so that the ratio (density) of the magnetic carrier in the developer has increased, the magnetic permeability around the flat coil board 6 increases. As a result, the inductance of the flat coil board 6 increases. The larger the ratio (density) of the magnetic carrier in the developer is, the larger the denominator of the foregoing equation becomes. The frequency of the output signal of the LC oscillation circuit 50 (second inverter INV2) becomes lower. Meanwhile, the smaller the ratio (density) of the magnetic carrier in the developer is, the smaller the denominator of the equation becomes. The frequency of the output signal of the LC oscillation circuit 50 (second inverter INV2) becomes higher.

The storage section 24 stores therein density measurement-dedicated data D1 (see FIG. 1). The density measurement-dedicated data D1 define a toner density corresponding to a frequency of an output signal of the LC oscillation circuit 50 (toner density sensor 5). The engine control section 40 recognizes a frequency of an output signal of the LC oscillation circuit 50 (toner density sensor 5). Then, the engine control section 40 looks up to the density measurement-dedicated data D1. The engine control section 40 selects a toner density corresponding to the recognized frequency from among the density measurement-dedicated data D1. The engine control section 40 recognizes the selected toner density as a toner density of the present developer.

(Embedment of Flat Coil Board 6 into Housing 11)

Next, embodiment of the flat coil board 6 into the housing 11 will be described with reference to FIG. 6.

The flat coil board 6 is fitted to the bottom surface 17 of the housing 11 of the developing device 1. As shown in FIG. 6, a fitting portion 7 (fitting recess, fitting hole) which allows a coil board to be put therein is provided in the housing 11 for fitting of the flat coil board 6. The fitting portion 7 is a fitting-use hole extending through the bottom surface 17 of the housing 11. The flat coil board 6 is put into the fitting portion 7. Various techniques are available for fitting of the flat coil board 6 (later described in detail). In this case, the flat coil board 6 can be positioned closer to the developer than when the flat coil board 6 is fitted to the housing 11 without providing a recess (hole).

Figure 6:
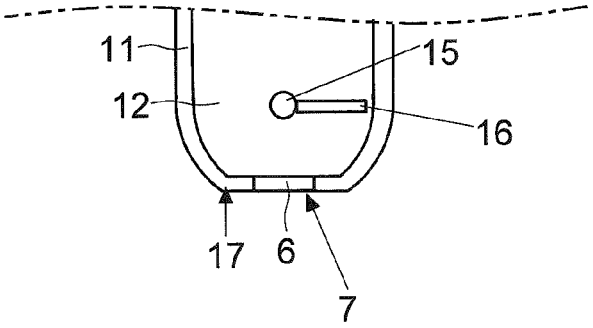
FIG. 6 is a view showing the embodiment of a flat coil board into the housing according to the embodiment.

As shown in FIG. 6, the flat coil board 6 is embedded to the bottom surface 17 of the developer tank 12. The bottom surface 17 is placed below the scraper 16 and the stirring member 15. The flat coil board 6 is fitted so that its upper and lower surfaces become parallel to the bottom surface 17 of the developing device 1. In other words, the widest-in-area surfaces of the flat coil board 6 are set parallel to the bottom surface 17 of the housing 11.

(Flow of Toner Density Detection)

Figure 7:
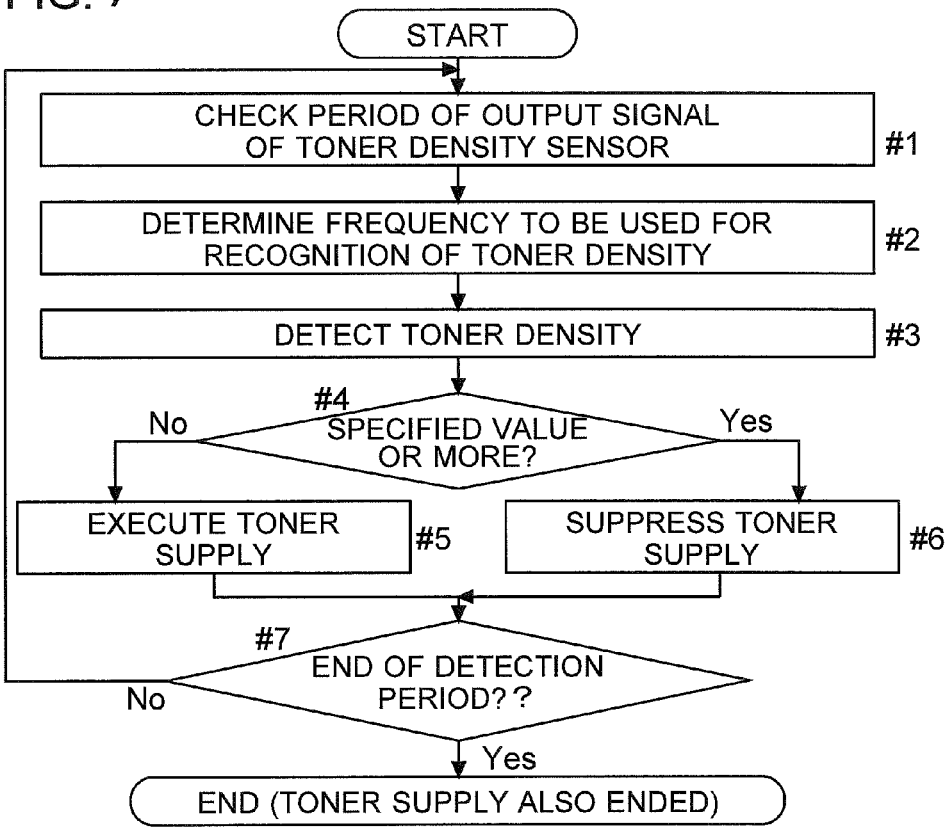
FIG. 7 is a flowchart showing an example of the flow of toner density detection according to the embodiment.
Figure 8:
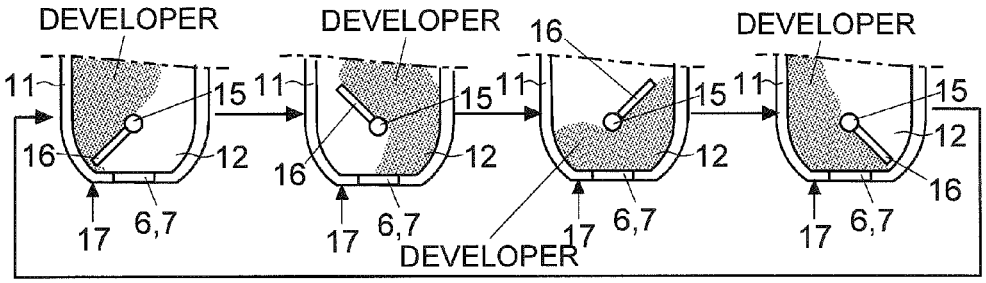
FIG. 8 is a view showing an example of operation of a stirring member according to the embodiment.

Next, an example of the flow of toner density detection with the developing device 1 according to the embodiment will be described with reference to FIGS. 7 to 9. A start of FIG. 7 is a time point when the detection of toner density is started with use of the toner density sensor 5. The detection of toner density is executed during a predetermined detection period. The detection period may be set to, for example, a period from a start of a printing job (start of rotation of the stirring member 15) until a stop of the rotation of the stirring member 15 due to an end of the printing job. The stirring member 15 may be rotated by start-up process involved in main power-on or recovery from the power-saving mode (a start-up process for setting the printer 100 ready to print). The detection period may be set to a period from a start of rotation of the stirring member 15 until a stop of rotation of the stirring member 15 due to completion of the start-up process. In addition, the flowchart of FIG. 7 is implemented for each developing device 1.

The detection of toner density can be carried out while the stirring member 15 is rotated. FIG. 8 shows an aspect in which the rotational angle of the scraper 16 (blade) placed above the flat coil board 6 is changed over in steps of 90 degrees clockwise. FIG. 8 shows an example of the state of toner inside the developing device 1 (developer tank). FIG. 8 shows states in which the scraper 16 (blade) is at rotational angles of 225°, 135°, 45°, and 315°, respectively, in order from left to right in the figure. FIG. 8 depicts the developer inside the developing device 1 by halftone dots.

When old developer has stuck to a wall inside the developing device 1, there may occur errors in detected toner densities. Therefore, the scraper 16 scrapes the side surfaces and bottom surface of the developing device 1 (developer tank). The scraper 16 prevents fixation of the toner.

For fulfillment of precision toner density detection with the toner density sensor 5 (flat coil board 6), it is preferable that developer located near the sensor plane (flat surface of the flat coil board 6) be in a dense state. In the state that the scraper 16 is scraping the developer upward from below (the state of FIG. 8 in which the rotational angle of the scraper 16 is 225° or 135°), the developer located near the upper surface of the flat coil board 6 is smaller in quantity.

In contrast, in the state that the scraper 16 is at such a rotational angle as to press the developer downward (the state of FIG. 8 in which the rotational angle of the scraper 16 is 45° or 315°), the developer located on the upper surface of the flat coil board 6 is higher in density.

The engine control section 40 checks the frequency of the oscillation circuit within a detection angle range and recognizes the toner density in the developer. The detection angle range is predetermined. The detection angle range is such an angular range of the rotational angle of the stirring member 15 that the developer is pressed against the flat coil board 6. The engine control section 40 checks the frequency of the output signal of the toner density sensor 5 during a period of such rotational angles that the stirring member 15 presses the developer against the flat coil board 6, out of each one-rotation period of the stirring member 15 (scraper 16).

The detection angle range can be determined as required. The detection angle range is determined so as to fall within a range from an angle at which the scraper 16 starts to rotate downward (e.g., 90°) to a rotational angle at which an end portion of the scraper 16 reaches an upper portion of the flat coil board 6 (a right-side end portion of the flat coil board 6 in FIG. 8). The detection angle range may be determined to be a range under which the rotational angle of the scraper 16 remains within the range of 45° to 315°.

Figure 9:
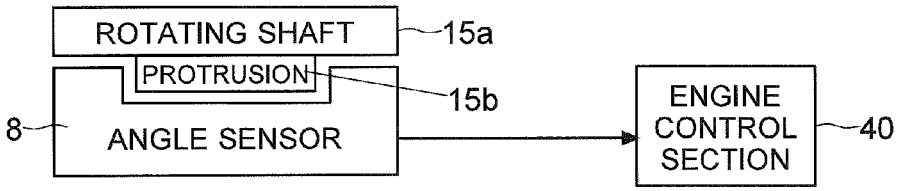
FIG. 9 is a diagram showing an example of the structure for detecting a rotational angle of the stirring member according to the embodiment.

For detection of the rotational angle of the stirring member 15, an angle sensor 8 (second sensor) is provided in the developing device 1 (see FIG. 9). Based on an output of the angle sensor 8, the engine control section 40 checks the frequency of the output signal of the toner density sensor 5 under the condition that the rotational angle of the stirring member 15 is within the detection angle range. The angle sensor 8 to be used is not particularly limited. In this embodiment, a transmission type optical sensor is used as the angle sensor 8. An output of the transmission type optical sensor is inputted to the engine control section 40. A protrusion 15*b* for shielding a light-emitting portion and a light-receiving portion of the transmission type optical sensor from light is attached to a rotating shaft 15*a* of the stirring member 15. That is, each time the rotational angle of the scraper 16 comes to a specific angle (every round of the stirring member 15), the protrusion 15*b* causes the output level of the transmission type optical sensor to be changed (High to Low, or Low to High). Then, the protrusion 15*b* is so provided as to shield the light-emitting portion and the light-receiving portion from light at an angle at which the detection angle range starts. Based on an output of the angle sensor 8, the engine control section 40 recognizes that the rotational angle of the stirring member 15 has entered the detection angle range.

The engine control section 40 checks the period (frequency) of the output signal of the toner density sensor 5 until the rotational angle of the stirring member 15 goes out of the detection angle range. The engine control section 40 may instead be so set as to check the period (frequency) of the output signal of the toner density sensor 5 during a predetermined time period starting with a change of the output level of the angle sensor 8. The predetermined time period is a time period required for the rotation over the detection angle range at a rotational speed pursuant to specifications of the stirring member 15. Further, based on a change of the output level of the angle sensor 8, the engine control section 40 may measure a time period required for one rotation of the stirring member 15. In this case, the engine control section 40 checks the period (frequency) of the output signal of the toner density sensor 5 until a time of measured time x (detection angle range/360) elapses from a change of the output level of the angle sensor 8.

Reverting to FIG. 7, the flow of toner density detection will be described. Upon rotation (start) of the stirring member 15, the engine control section 40 checks the frequency of the output signal of the toner density sensor 5 (oscillation circuit) (step #1). The engine control section 40 checks the period of the output signal (rectangular wave) of the toner density sensor 5 (LC oscillation circuit 50). The checking is done based on an output signal issued while the rotational angle of the stirring member 15 falls within the detection angle range. The engine control section 40 determines a frequency to be used for recognition of the toner density (step #2). In this description, the engine control section 40 determines an average value of periods of rectangular waves issued while the rotational angle of the stirring member 15 remains within the detection angle range. With use of the average value, the engine control section 40 determines an average frequency of the rectangular waves.

Based on the determined average frequency, the engine control section 40 detects (recognizes) a toner density (step #3). More specifically, the engine control section 40 looks up to the density measurement-dedicated data D1. The engine control section 40 determines a toner density corresponding to the determined average frequency.

The engine control section 40 checks whether or not a detected toner density is a specified value or more (step #4). When the toner density is less than the specified value (No at step #4), the engine control section 40 instructs the supply mechanism 49 to execute toner supply (step #5). When the toner density is the specified value or more (Yes at step #4), the engine control section 40 keeps the supply mechanism 49 from executing toner supply (step #6). When the toner density has been recovered to the specified value or more by toner supply, the response to step #4 comes to a Yes, where the engine control section 40 stops the supply mechanism 49 from operating.

After step #5 and step #6, the engine control section 40 checks whether or not the detection period has been ended (step #7). When the detection period has not been ended (No at step #7), the flow returns to step #1. When the detection period has been ended (Yes at step #7), the flow is ended (END). In addition, while the supply mechanism 49 is operating, the engine control section 40 instructs the supply mechanism 49 to terminate the toner supply.

(Fitting of Flat Coil Board 6 with Use of Insulating Film 9)

Next, fitting of the flat coil board 6 with use of an insulating film 9 will be described with reference to FIGS. 10 to 12.

For fitting of the flat coil board 6, the fitting portion 7 is provided at the bottom surface 17 of the housing 11 (developer tank 12). The fitting portion 7 has a horizontal area equal to or larger than the planar area (upper/lower surface area) of the flat coil board 6. Also, as shown in FIGS. 11 and 12, the fitting portion 7 extends through the housing 11. Into a recess (fitting hole) through which the fitting portion 7 extends, the flat coil board 6 is to be fitted.

The fitting portion 7 extends through the housing 11. In order to prevent leaks of the developer tank 12 from the fitting portion 7, an insulating film 9 can be used. The insulating film 9 is thinner than 1 mm. The insulating film 9 is provided so as to close the fitting portion 7. The insulating film 9 is affixed inside the housing 11 (at the bottom surface of the developer tank 12). As shown in FIGS. 11 and 12, the insulating film 9 is positioned between the developer and the upper surface of the flat coil board 6 embedded to the fitting portion 7. The flat coil board 6 is embedded to the fitting portion 7 so that the upper surface and the lower surface of the flat coil board 6 become parallel to the bottom surface 17.

The insulating film 9 keeps the flat coil board 6 out of direct contact with the developer, i.e., electrically insulated therefrom. Therefore, as shown in the upper view of FIG. 10, the coil pattern 61 can be formed on the upper surface of the uppermost layer (layer facing the developer) of the flat coil board 6.

Figure 10:
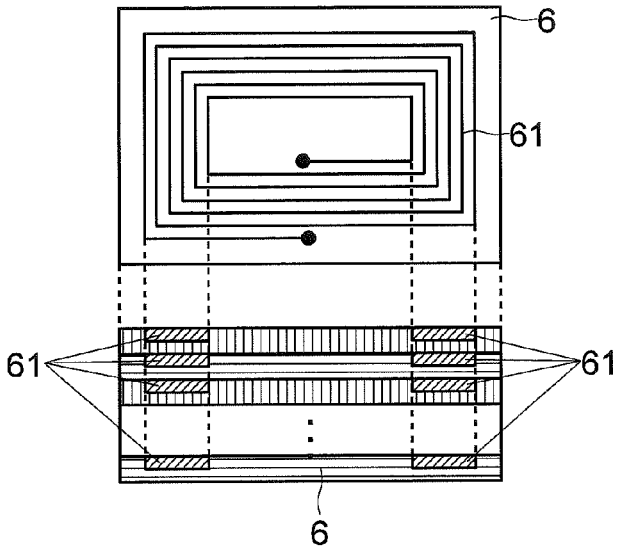
FIG. 10 is a view showing an example of the flat coil board with use of an insulating film.

As shown in the lower view of FIG. 10, the flat coil board 6 has a plurality of layers. The coil pattern 61 is formed on the upper surface of each layer. The coil pattern 61 of each layer is connected to the coil pattern 61 of its neighboring layer by via technique. As a result, the coil can be downsized.

Figure 11:
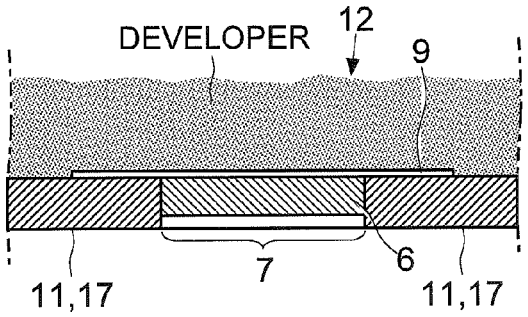
FIG. 11 is a view showing an example of fitting of the flat coil board with use of an insulating film.

FIG. 11 shows an example in which a fitting hole extending through the bottom surface 17 is provided as the fitting portion 7. FIG. 11 shows an example in which the horizontal area of the fitting portion 7 is equal, or nearly equal, to the planar area of the flat coil board 6. FIG. 11 shows an example in which the flat coil board 6, having the coil pattern 61 provided on the upper-side surface, is fitted into the fitting portion 7. The flat coil board 6 is closely fitted to the fitting portion 7. As a result of this, the flat coil board 6 can be positioned as close to the developer as a distance of separation by one thin film (insulating film 9).

Figure 12:
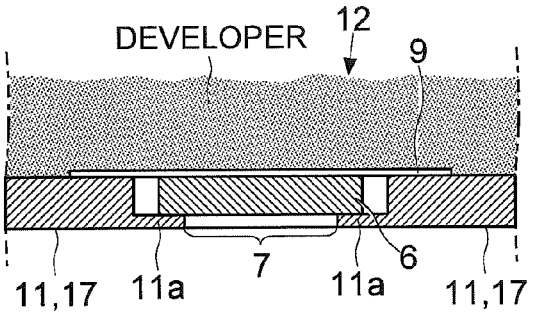
FIG. 12 is a view showing an example of fitting of the flat coil board with use of an insulating film.

FIG. 12 shows an example in which a fitting hole extending through the bottom surface 17 is provided as the fitting portion 7. FIG. 12 shows an example in which an upper-side horizontal area of the fitting portion 7 is set wider than the planar area of the flat coil board 6. However, only with the arrangement as it is, the flat coil board 6 would fall down. Accordingly, as shown in FIG. 12, a step gap portion 11*a* is provided. The step gap portion 11*a* is provided under the fitting portion 7 so as to be in contact with the lower surface of the flat coil board 6, supporting the flat coil board 6 to prevent its fall.

The step gap portion 11*a* is part of the bottom surface 17 of the housing 11. The step gap portion 11*a* is a portion of the bottom surface 17 that is protruded inward of the fitting portion 7. The step gap portion 11*a* is provided along each side line of the rectangular-shaped fitting portion 7. As viewed from above, the step gap portion 11*a* is square doughnut-shaped. A vertical section forming part of the fitting portion 7 is generally L-shaped. The upper surface of the step gap portion 11*a* is in contact with the lower surface of the flat coil board 6. The flat coil board 6 is sandwiched between the insulating film 9 and the step gap portion 11*a*. As a result of this, the flat coil board 6 can be positioned as close to the developer as a distance of separation by one thin film (insulating film 9).

With regard to manufacturing process, the flat coil board 6 is set above the step gap portion 11*a* from inside the developing device 1 (developer tank 12). The insulating film 9 is affixed to upper part of the flat coil board 6 from inside the developing device 1 (developer tank 12). For stronger fitting of the flat coil board 6, an adhesive may be filled between the flat coil board 6 and longitudinal walls of the fitting portion 7.

An outer-side (bottom surface 17-side) surface of the insulating film 9 may be provided as an adhesive surface. Then, from inside the housing 11, the adhesive surface is affixed so as to close the fitting portion 7. Further, the coil board is affixed to the adhesive surface. Thus, the flat coil board 6 can be held so as to be prevented from falling.

(Fitting of Flat Coil Board 6 without Use of Insulating Film 9)

Figure 13:
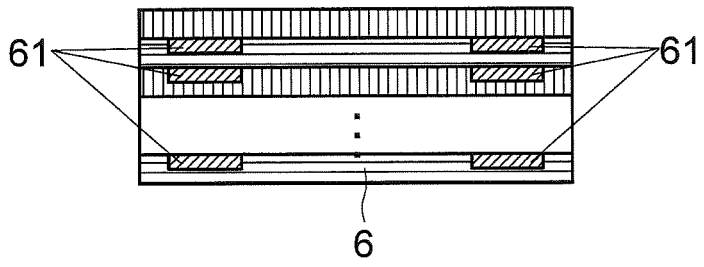
FIG. 13 is a view showing an example of the flat coil board without use of an insulating film.

Next, fitting of the flat coil board 6 without use of the insulating film 9 will be described with reference to FIGS. 13 to 15.

Without use of the insulating film 9, a fitting portion 7 is also provided at the bottom surface 17 of the housing 11 (developer tank 12) for the purpose of fitting of the flat coil board 6. The horizontal area of the fitting portion 7 is equal to or wider than the planar area (upper/lower surface area) of the flat coil board 6. As shown in FIGS. 14 and 15, the fitting portion 7 extends through the housing 11. The flat coil board 6 is fitted to a recess (fitting hole) through which the fitting portion 7 extends. Then, the flat coil board 6 is embedded to the fitting portion 7 in such fashion that the upper surface (lower surface) of the flat coil board 6 becomes parallel to the bottom surface 17.

Without use of the insulating film 9, the flat coil board 6 comes into contact with the developer. Therefore, as shown in upper part of FIG. 13, no coil pattern 61 is formed on the upper-side (contact-with-developer side) plane of the flat coil board 6. Also without use of the insulating film 9, the flat coil board 6 has a plurality of layers. The coil pattern 61 is formed on the upper surface of each layer except the uppermost lower (see lower part of FIG. 13). The coil pattern 61 of each layer is connected to the coil pattern 61 of its neighboring layer by via technique (via hole).

Figure 14:
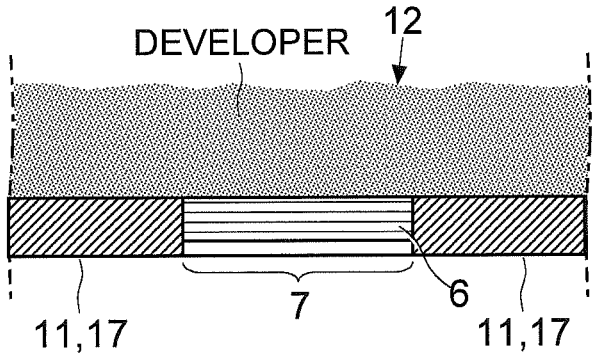
FIG. 14 is a view showing an example of fitting of the flat coil board without use of an insulating film.

FIG. 14 shows an example in which a fitting hole extending through the bottom surface 17 is provided as the fitting portion 7. FIG. 14 shows an example in which the horizontal area of the fitting portion 7 is set equal to the planar area of the flat coil board 6. FIG. 14 shows an example in which the flat coil board 6 is fitted into the fitting portion 7 while its surface having no pattern formed thereon is positioned at upside. The flat coil board 6 is closely fitted into the fitting portion 7. The developer is never leaked. Thus, the flat coil board 6 can be positioned closer to the developer to the maximum. Moreover, the lower side of the flat coil board 6 may be buried in adhesive so as to prevent leaks of the developer.

Figure 15:
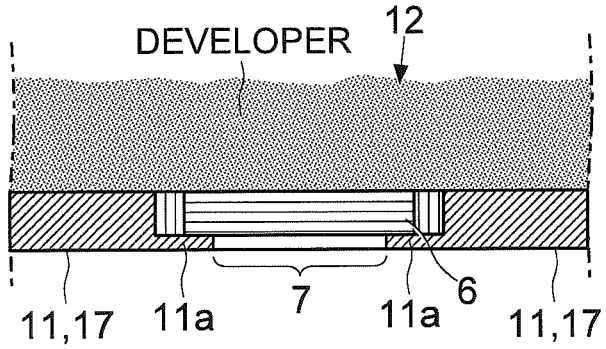
FIG. 15 is a view showing an example of fitting of the flat coil board without use of an insulating film.

FIG. 15 shows an example in which a fitting hole extending through the bottom surface 17 is provided as the fitting portion 7. FIG. 15 shows an example in which the upper-side horizontal area of the fitting portion 7 is set wider than the planar area of the flat coil board 6. As in the case of FIG. 12, the step gap portion 11*a* is provided under the fitting portion 7. The step gap portion 11*a* is in contact with the lower surface of the coil board, supporting the flat coil board 6 to prevent its fall.

The step gap portion 11*a* is similar to the one shown in FIG. 12. More specifically, the step gap portion 11*a* is part of the bottom surface 17 of the housing 11. The step gap portion 11*a* is provided along each side line of the rectangular-shaped fitting portion 7. As viewed from above, the step gap portion 11*a* is square doughnut-shaped. A vertical section forming part of the fitting portion 7 is generally L-shaped. The upper surface of the step gap portion 11*a* is in contact with the lower surface of the flat coil board 6. As a result of this, the flat coil board 6 can be positioned closer to the developer to the maximum.

With regard to manufacturing process, the flat coil board 6 is set above the step gap portion 11*a* from inside the developing device 1 (developer tank 12). In the case where no insulating film 9 is provided, a gap-filling sealing material such as adhesive may be filled between the flat coil board 6 and the fitting portion 7 or the step gap portion 11*a* so as to prevent leaks of the developer. Without use of the insulating film 9, the lower surface of the flat coil board 6 may be provided as an adhesive surface. From inside the housing 11, the flat coil board 6 is affixed to the upper surface of the step gap portion 11*a* so as to close the hole of the fitting portion 7 (step gap portion 11*a*).

As described hereinabove, the developing device 1 according to the embodiment includes: a housing 11 for housing therein a developer containing toner and magnetic carrier; and a toner density sensor 5 (first sensor) including an oscillation circuit (LC oscillation circuit 50) and a coil board (flat coil board 6) which is part of the oscillation circuit and on which a coil pattern 61 is formed, wherein a fitting portion 7 formed by recessing an outer surface of the housing 11 is provided in the housing 11 so as to allow the coil board 6 fitted at a position closer to the developer than the outer surface of the housing 11, and wherein the coil board is fitted to the fitting portion 7.

With this constitution, the coil board (flat coil board 6) can be fitted at a position closer to the developer (magnetic carrier) than the outer surface of the housing 11. The distance between the coil board and the developer can be made smaller than conventional. As a result, variations of the frequency of the sensor output relative to variations of toner density become larger than conventional. That is, the sensor sensitivity can be enhanced higher than conventional. Correct detection of the toner density is achievable. Also, the fitting portion 7 has only to be sized so as to allow the coil board to be fitted therein. There is no problem in terms of the strength of the developing device 1.

An insulating film 9 may be provided in the developing device 1. In this case, the fitting portion 7 is a fitting hole extending through the housing 11. The insulating film 9 is provided inside the housing 11 so as to be positioned between the developer and the coil board (flat coil board 6) embedded in the fitting portion 7 and to close the fitting portion 7. As a result of this, the coil board can be positioned as close to the developer as a distance of separation by one insulating film 9. Therefore, the distance between the developer and the coil board can be made far shorter than conventional. Correct detection of the toner density is achievable. Moreover, leaks of the developer to outside are prevented by the insulating film 9.

In a case where the insulating film 9 is provided in the developing device 1 while a fitting hole extending through the bottom surface 17 of the developing device 1 is provided as the fitting portion 7, the insulating film 9, one surface of which is an adhesive surface, is affixed inside the housing 11 so as to close the fitting portion 7 with the adhesive surface positioned at underside. The coil board (flat coil board 6) is affixed to the adhesive surface. A coil pattern 61 is formed on an upper surface of the coil board. As a result of this, only by the affixation, the coil board can be fixed at a position extremely close to the developer. The fixation is easily achievable. Also, the coil pattern 61 is provided on the upper surface of the flat coil board 6. The coil pattern 61, while maintained contactless with the developer, can be made closer to the developer to the maximum.

Without use of the insulating film 9, the coil board (flat coil board 6) has a plurality of layers each having a coil pattern 61 formed thereon, where a coil pattern of each layer is connected to a coil pattern of up/down neighboring another layer by via technique and where no coil pattern 61 is formed on an upper surface of the coil board. The coil board is fitted into the fitting portion 7. As a result of this, the coil board can be positioned as close to the developer as possible. Further, coils of individual layers are connected to one another by via technique. As a result of this, the surface of the coil board can be completely covered with resist. Since the developer and the coil board are made as close to each other as possible, accurate detection of toner density can be achieved. Still, no coil pattern 61 is formed on the surface. The coil pattern 61 and the developer are kept from direct contact with each other.

For inter-layer connection of the coil patterns by via technique, a plurality of techniques are available. The technique is not limited to any one particular connection technique. For example, a concrete implemental technique for via technique may be a method in which a lead wire is passed through the coil board (flat coil board 6), a method in which eyelets are provided in the coil board, a plated-through-hole method in which the coil board is copper-plated, a conductive-paste filling method in which a paste with a metallic conductive material mixed therein is embedded in the coil board, or the like.

A fitting hole extending through the housing 11 may be provided, as the fitting portion 7, in the bottom surface 17 of the developing device 1, and a step gap portion 11*a* may be formed in the housing 11 so as to be positioned under the fitting portion 7 and in contact with a lower surface of the coil board (flat coil board 6), thereby supporting the coil board for prevention of the coil board from falling. As a result of this, positioning of the coil board can be achieved with simplicity. Further, the coil board is set from inside the housing 11. As a result of this, the coil board never falls down. The coil board itself serves a role of closing the fitting portion 7. Leaks of the developer to outside can also be prevented.

As part of the developing device, there may be included a control section (engine control section 40) for detecting a toner density in the developer based on a frequency of the oscillation circuit (LC oscillation circuit 50), a stirring member 15 for stirring the developer, and an angle sensor 8 (second sensor) for detecting a rotational angle of the stirring member 15. In this case, based on an output of the angle sensor 8, the control section detects a toner density in the developer on a basis of a frequency of the oscillation circuit within a predetermined detection angle range under which a rotational angle of the stirring member 15 is such an angle that the developer is pressed against the coil board (flat coil board 6). The stirring member 15 is rotated so as to press the developer against the coil board. As a result, there can be provided a state in which the developer is larger in quantity in vicinities of the coil board. Still, the toner density is detected on the besides of a frequency in the state in which the developer is larger in quantity in vicinities of the coil board. Thus, detection errors can be made less than conventional. More accurate detection of toner density than conventional can be achieved.

The image forming apparatus (printer 100) includes the above-described developing device 1. Since more accurate detection of toner density than conventional is achievable, there can be provided an image forming apparatus capable of maintaining the toner density in the developer at proper level. Since the toner density is maintained at proper value, there can be provided an image forming apparatus capable of maintaining image quality at high level.

Although an embodiment of the disclosure has been fully described hereinabove, yet the disclosure is not limited to the scope of this description and may be modified in various ways unless those modifications depart from the gist of the disclosure.

What is claimed is:

1. A developing device comprising:

a housing for housing therein a developer containing toner and magnetic carrier;

a first sensor including an oscillation circuit and a coil board which is part of the oscillation circuit and on which a coil pattern is formed; and an insulating film, wherein a fitting portion formed by recessing an outer surface of the housing is provided in the housing so as to allow the coil board to be fitted at a position closer to the developer than the outer surface of the housing, the coil board is fitted to the fitting portion, the fitting portion is a fitting hole extending through the housing, the fitting portion is provided at a bottom surface of the developing device, the insulating film is positioned between the developer and the coil board embedded in the fitting hole, the insulating film, one surface of which is an adhesive surface, is affixed inside the housing so as to close the fitting hole with the adhesive surface positioned at underside of the housing, the coil pattern is formed on an upper surface of the coil board, and the upper surface of the coil board is affixed to the adhesive surface so as to face the developer.

2. The developing device according to claim 1, wherein the housing has a step gap portion which is positioned under the fitting portion so as to be in contact with a lower surface of the coil board, thereby supporting the coil board for prevention of the coil board from falling.

3. The developing device according to claim 1, further comprising:

a control section for detecting a toner density in the developer based on a frequency of the oscillation circuit;

a stirring member for stirring the developer; and a second sensor for detecting a rotational angle of the stirring member, wherein based on an output of the second sensor, the control section detects the toner density in the developer on a basis of a frequency of the oscillation circuit within a predetermined detection angle range under which the rotational angle of the stirring member is such an angle that the developer is pressed against the coil board.

4. The developing device according to claim 3, wherein the control section exerts control for executing toner supply to the developing device when a detected toner density is less than a specified value, and suppresses control for suppressing the toner supply to the developing device when the detected toner density is the specified value or more.

5. An image forming apparatus including the developing device according to claim 1.

6. A developing device comprising:

a housing for housing therein a developer containing toner and magnetic carrier; and a first sensor including an oscillation circuit and a coil board which is part of the oscillation circuit and on which a coil pattern having a plurality of layers each having a coil pattern formed thereon, where a coil pattern of each layer is connected to a coil pattern of another layer by via technique and where no coil pattern is formed on an upper surface of the coil board, wherein a fitting portion formed by recessing an outer surface of the housing is provided in the housing so as to allow the coil board to be fitted at a position closer to the developer than the outer surface of the housing, and the coil board is fitted to the fitting portion, the fitting portion is a fitting hole provided at a bottom surface of the developing device so as to extend through the housing, the coil board is embedded in the fitting hole so as to close the fitting hole, and the upper surface of the coil board is in contact with the developer.

7. The developing device according to claim 6, wherein the housing has a step gap portion which is positioned under the fitting portion so as to be in contact with a lower surface of the coil board, thereby supporting the coil board for prevention of the coil board from falling.

8. The developing device according to claim 6, further comprising:

a control section for detecting a toner density in the developer based on a frequency of the oscillation circuit;

a stirring member for stirring the developer; and a second sensor for detecting a rotational angle of the stirring member, wherein based on an output of the second sensor, the control section detects a toner density in the developer on a basis of a frequency of the oscillation circuit within a predetermined detection angle range under which the rotational angle of the stirring member is such an angle that the developer is pressed against the coil board.

9. The developing device according to claim 8, wherein the control section exerts control for executing toner supply to the developing device when a detected toner density is less than a specified value, and suppresses control for suppressing the toner supply to the developing device when the detected toner density is the specified value or more.

10. An image forming apparatus including the developing device according to claim 6.

11. A method for fitting a coil board to a developing device, comprising:

housing a developer containing toner and magnetic carrier inside a housing of the developing device;

using a first sensor including an oscillation circuit and a coil board on which a coil pattern as part of the oscillation circuit is formed;

providing, in the housing, a fitting portion formed by recessing an outer surface of the housing so as to allow the coil board to be fitted at a position closer to the developer than the outer surface of the housing;

fitting the coil board to the fitting portion;

configuring the fitting portion as a fitting hole extending through the housing;

providing the fitting portion at a bottom surface of the developing device;

positioning the insulating film between the developer and the coil board embedded in the fitting hole;

making one surface of the insulating film an adhesive surface;

affixing the insulating film inside the housing so as to close the fitting hole with the adhesive surface positioned at underside of the housing;

forming the coil pattern on an upper surface of the coil board; and affixing the upper surface of the coil board to the adhesive surface so as to face the developer.

* * * * *